US010570670B2

(12) United States Patent
Bird et al.

(10) Patent No.: US 10,570,670 B2
(45) Date of Patent: Feb. 25, 2020

(54) DOWNHOLE CUTTING TOOL HAVING SENSORS OR RELEASABLE PARTICLES TO MONITOR WEAR OR DAMAGE TO THE TOOL

(71) Applicant: Halliburton Energy Services, Inc., Houston, TX (US)

(72) Inventors: Jay Stuart Bird, The Woodlands, TX (US); Kazi M. Rashid, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 368 days.

(21) Appl. No.: 14/902,162

(22) PCT Filed: Mar. 24, 2014

(86) PCT No.: PCT/US2014/031606
§ 371 (c)(1),
(2) Date: Dec. 30, 2015

(87) PCT Pub. No.: WO2015/147786
PCT Pub. Date: Oct. 1, 2015

(65) Prior Publication Data

US 2016/0369569 A1 Dec. 22, 2016

(51) Int. Cl.

| | |
|---|---|
| ***E21B 12/02*** | (2006.01) |
| ***E21B 10/08*** | (2006.01) |
| ***E21B 10/42*** | (2006.01) |
| ***E21B 10/55*** | (2006.01) |
| ***E21B 10/56*** | (2006.01) |

(52) U.S. Cl.
CPC ..... *E21B 12/02* (2013.01); *E21B 10/08* (2013.01); *E21B 10/42* (2013.01); *E21B 10/55* (2013.01); *E21B 10/56* (2013.01)

(58) Field of Classification Search
CPC ..... E21B 12/02; E21B 10/56; E21B 10/55; E21B 10/08; E21B 10/42
See application file for complete search history.

(56) References Cited

U.S. PATENT DOCUMENTS 6,691,802 B2 * 2/2004 Schultz ..... E21B 12/02 166/250.01
2010/0139987 A1 * 6/2010 Hunt ..... E21B 10/00 175/369

(Continued)

FOREIGN PATENT DOCUMENTS

CN 1512032 A 7/2004

OTHER PUBLICATIONS

International Search Report and Written Opinion for PCT/US2014/031606 dated Dec. 23, 2014.

*Primary Examiner* — David J Bagnell
*Assistant Examiner* — Yanick A Akaragwe
(74) *Attorney, Agent, or Firm* — Alan Bryson; C. Tumey Law Group PLLC

(57) ABSTRACT

A wellbore formation system includes a downhole cutting tool having a body and at least one cutting element. A sensor is coupled to the downhole cutting tool, and the sensor includes a transmitter configured to transmit a signal prior to wear on a portion of the downhole cutting tool reaching a first amount. The sensor ceases transmission of the signal when the wear on the portion of the downhole cutting tool reaches the first amount.

20 Claims, 4 Drawing Sheets

(56) References Cited

U.S. PATENT DOCUMENTS

| | | | | |
|---|---|---|---|---|
| 2011/0266055 | A1 | 11/2011 | DiGiovanni et al. | |
| 2011/0283839 | A1 | 11/2011 | Teodorescu et al. | |
| 2011/0286304 | A1* | 11/2011 | Thigpen | G01N 3/44 367/25 |
| 2012/0325564 | A1 | 12/2012 | Vaughn et al. | |
| 2013/0008717 | A1 | 1/2013 | Deen | |
| 2013/0256032 | A1 | 10/2013 | Palmer | |
| 2013/0270008 | A1 | 10/2013 | DiGiovanni et al. | |
| 2015/0090456 | A1* | 4/2015 | Turkenburg | G01V 9/00 166/305.1 |

* cited by examiner

DOWNHOLE CUTTING TOOL HAVING SENSORS OR RELEASABLE PARTICLES TO MONITOR WEAR OR DAMAGE TO THE TOOL

1 FIELD OF THE INVENTION

The present disclosure relates generally to tools, systems, and methods for detecting wear or damage to downhole cutting tools.

2 DESCRIPTION OF RELATED ART

Wells are drilled to various depths to access and produce oil, gas, minerals, and other naturally-occurring deposits from subterranean geological formations. The drilling of a well typically is accomplished with a drill bit that is rotated to advance the wellbore by removing topsoil, sand, clay, limestone, calcites, dolomites, or other materials. The drilling process is capable of causing significant wear to drill bits and other downhole cutting tools. Damage to the drill bit may, in some cases, cause damage to other parts of the drilling system, including the drill string and the drive system. In some cases, a damaged drill bit may be refurbished or drilling operations may be modified to prolong the life of a worn drill bit.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the disclosed tools, systems, and methods; and it is understood that other embodiments may be utilized and that logical structural, mechanical, electrical, and chemical changes may be made without departing from the spirit or scope of the disclosure. To avoid detail not necessary to enable those skilled in the art to practice the embodiments described herein, the description may omit certain information known to those skilled in the art. The following detailed description, therefore, is not to be taken in a limiting sense; and the scope of the illustrative embodiments is defined only by the appended claims.

The embodiments described herein relate to systems and methods for indicating wear on a downhole cutting tool. The system may include sensors or particles that are associated with the downhole cutting tool and are capable of indicating that wear or damage at a particular location of the downhole cutting tool has occurred, which may provide for the early detection of events that may cause catastrophic failure in the well or may prevent the simple recovery of the downhole cutting tool. The systems and methods described herein may also provide an indication that wear of a particular amount has occurred in one or more locations on the downhole cutting tool. In an embodiment having a sensor, the sensor is coupled to the downhole cutting tool and is configured to transmit a signal during operation of the downhole cutting tool prior to wear on the downhole cutting reaching a first amount. When wear of the downhole cutting tool reaches the first amount, the sensor ceases transmission of the signal thus indicating that wear of the first amount has occurred. In another embodiment, a particle having a particle characteristic is coupled to the downhole cutting tool, and upon wear of the downhole cutting tool, the particle is released from the downhole cutting tool. When released, a signature associated with the particle characteristic is detected thus indicating wear of the downhole cutting tool.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion and, thus, should be interpreted to mean "including, but not limited to." Unless otherwise indicated, as used throughout this document, "or" does not require mutual exclusivity.

Figure 1:
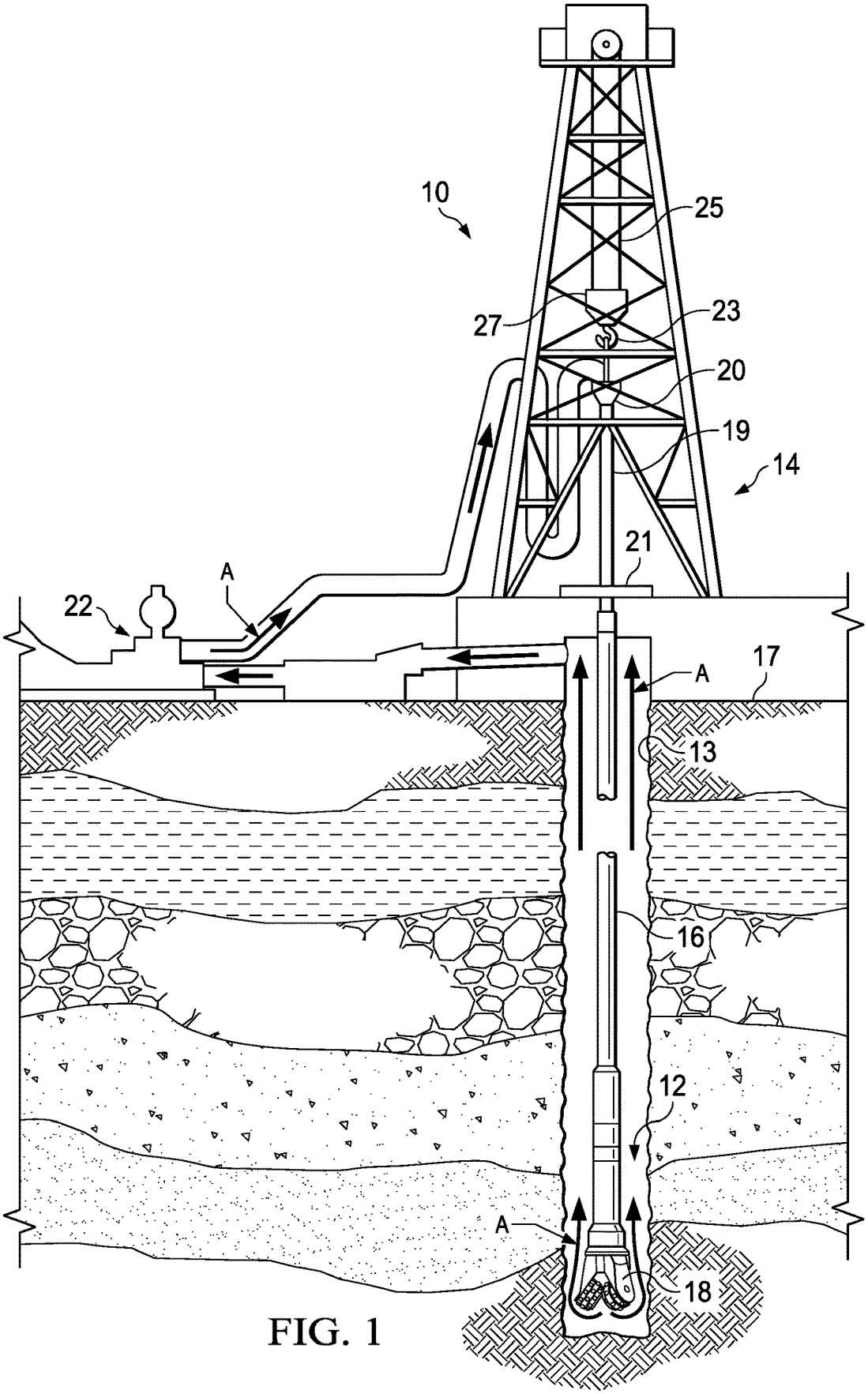
FIG. 1 illustrates an elevation view of a wellbore formation system having a downhole cutting tool with a sensor or particles for detecting wear on the downhole cutting tool according to an illustrative embodiment.

FIG. 1 is an elevation view of a wellbore formation system 10 having a downhole cutting tool 12 with a sensor or particles for detecting wear on the downhole cutting tool according to an illustrative embodiment. The wellbore formation system 10 may be used to form a wellbore 13 of a well 14. The well 14 is illustrated onshore in FIG. 1, but alternatively the wellbore formation system 10 may be deployed in a sub-sea well accessed by a fixed or floating platform.

The wellbore formation system 10 employs sections of pipe to form a drill string 16 that is lowered into the wellbore 13. At or near a surface 17 of the well 14, the drill string 16 may include or be coupled to a kelly 19. The kelly 19 may have a square, hexagonal or octagonal cross-section. The kelly 19 is connected at one end to the drill string 16 and at an opposite end to a rotary swivel 20. The kelly 19 passes through a rotary table 21 that is capable of rotating the kelly 19, the drill string 16, and a drill bit 18. A hook 23, cable 25, traveling block 27, and hoist (not shown) are provided to lift or lower the drill bit 18, drill string 16, kelly 19 and rotary swivel 20. The kelly 19 and swivel 20 may be raised or lowered as needed to add additional sections of pipe to the drill string 16 as the drill bit 18 advances, or to remove sections of pipe from the drill string 16 when removal of the drill string 16 and drill bit 18 from the well 14 is desired.

In the embodiment illustrated in FIG. 1, the drill bit 18 is the downhole cutting tool 12, but in other embodiments, the downhole cutting tool 12 may be a reaming tool, a mill, or any other device that is used to cut, grind, or otherwise remove material from the well 14. A pump 22 may be provided to circulate drilling fluid or "mud" (as represented by arrows A) to the bottom of the wellbore through the drill string 16 and back to the surface through an annulus between the drill string 16 and the wellbore 13. As the drill bit 18 rotates, the applied weight-on bit ("WOB") forces cutting elements of the drill bit 18 into a substrate being drilled. The cutting elements of the drill bit 18 apply a compressive force to the substrate that exceeds the yield stress of the substrate, and induces fracturing in the substrate. The resulting fragments, referred to as "cuttings," are flushed away from a cutting face of the drill bit 18 by the drilling fluid flowing past the drill bit 18.

The downhole cutting tool 12 of the wellbore formation system 10 includes either or both of a sensor and a particle for detecting wear of the downhole cutting tool 12, or alternatively for determining that the downhole cutting tool 12 has fractured or is otherwise less capable of cutting material in the well 14. In embodiments having the sensor, the sensor may be coupled to the downhole cutting tool 12. The sensor is capable of transmitting a signal during operation of the downhole cutting tool 12 (e.g., during drilling operations by the drill bit 18). The signal may be received by a receiver positioned at or near the surface 17 of the well 14, or alternatively at a location within the wellbore 13. The sensor may be positioned on a surface or embedded within the downhole cutting tool 12 such that upon the downhole cutting tool 12 wearing by a first amount, the sensor ceases transmitting the signal. The sensor is essentially a "subsiding" or "dying" sensor that transmits or indicates a signal until a triggering event that indicates wear of a particular amount or wear or damage in a particular location of the downhole cutting tool 12. The sensor's cessation of transmission or indication may be due to impact with the sensor by a downhole material or substrate, or may be due to the sensor being exposed to downhole fluids or certain downhole conditions.

In embodiments having particles, a first particle may be disposed on the downhole cutting tool 12. The first particle has a first particle characteristic that exhibits a first signature. A second particle may be disposed on the downhole cutting tool 12 that has a second particle characteristic that exhibits a second signature. In these embodiments, a sensor may be provided that is configured to detect at least one of the first signature of the first particle characteristic and the second signature of the second particle characteristic when the first particle or the second particle is released from the downhole cutting tool. The positioning of the sensor may be at or near the surface 17 of the well 14, or alternatively within the wellbore 13. The release of the first or second particles may occur upon the downhole cutting tool 12 wearing by a first amount or a second amount, respectively. Alternatively, the release of the first particle may indicate wear or damage in a first location of the downhole cutting tool 12 at which the first particle is initially positioned. Similarly, the release of the second particles may indicate wear or damage in a second location of the downhole cutting tool 12 at which the second particle is initially positioned.

Figure 2A:
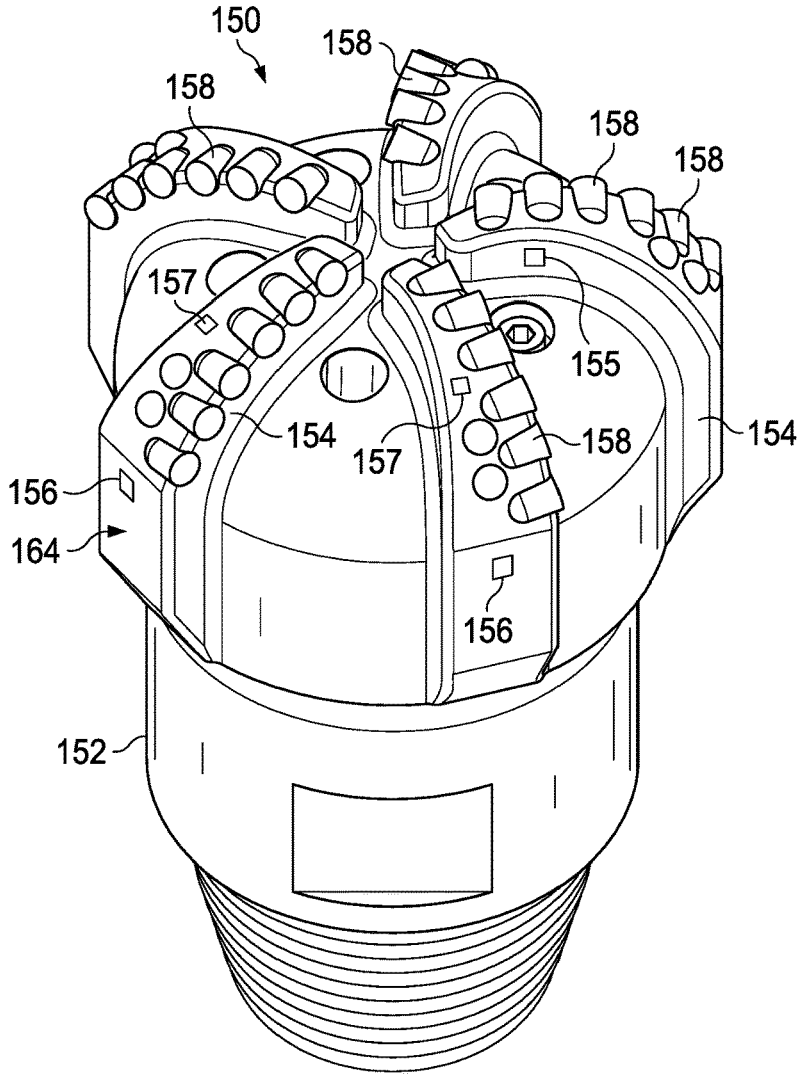
FIG. 2A illustrates a perspective view of a drill bit having sensors strategically arranged to determine or indicate wear or damage to the drill bit according to an illustrative embodiment.

FIG. 2A is a perspective view of a drill bit 150 having sensors strategically arranged to determine or indicate wear or damage to the drill bit 150 according to an illustrative embodiment. The drill bit 150 is a fixed-cutter drill bit and may be one example of a downhole cutting tool such as downhole cutting tool 12 of FIG. 1. The drill bit 150 includes a bit body 152 having raised blade regions 154. A plurality of cutting elements 158 is coupled to the bit body 150 in the blade regions 154 to assist the drill bit 150 in removing material during operation. The cutting elements 158 may be polycrystalline diamond cutters (PDCs), or in other embodiments may be carbide inserts or ceramic inserts. One or more sensors 155, 156, 157 may be coupled to the drill bit 150. In the embodiment illustrated in FIG. 2A, the sensors 155, 156, 157 are coupled to various surfaces of the bit body 152. These surfaces at which the sensors 155, 156, 157 are coupled are relatively protected locations, where the sensors 155, 156, 157 may encounter some abrasive contact but will not be fully dislodged from the drill bit 150 unless the drill bit 150 has experienced significant wear. The sensor 156 is located in a gauge region 164 of the drill bit 150, which may be a good area for placement of wear sensors. Wear in this area of the drill bit 150 may indicate that the wellbore the drill bit 150 is forming is not being formed to the desired diameter. The sensor 155 is positioned on a side of the blade region 154, while the sensor 157 is positioned on top of the blade region 154 between or proximate to cutting elements 158. The sensors may instead be placed on any surface of the drill bit 150 that is relatively protected from direct impact with materials prior to wear on the drill bit 150 occurring. Placement in areas that do not experience direct wear allows for the survival of the sensors until more significant wear to the drill bit 150 has occurred. Typically, placement of sensors 155, 157 in locations such as those illustrated in FIG. 2A assists in protecting the sensors 155, 157 from contact until another surface or structure (e.g., the PDCs) has been worn away.

In addition to or in lieu of positioning sensors 155, 156, 157 on surfaces of the drill bit 150, one or more sensor may be coupled to the cutting elements 158 as described below with reference to FIG. 2B.

Figure 2B:
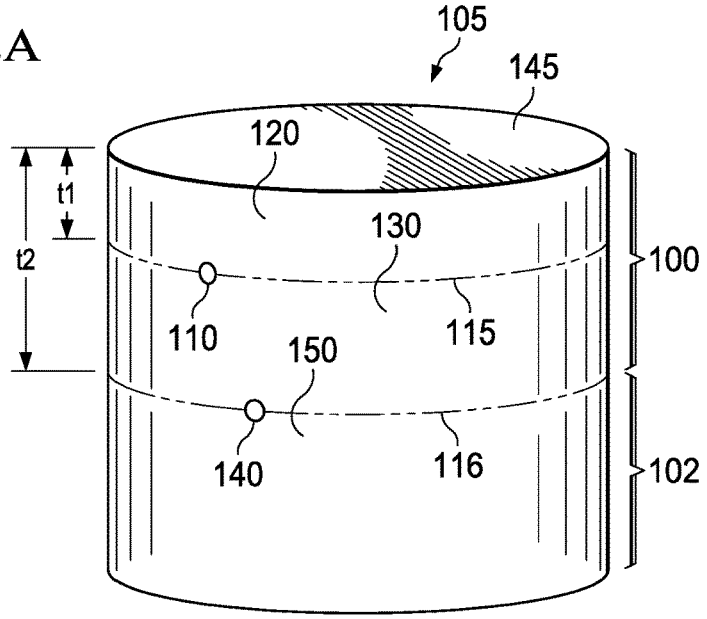
FIG. 2B illustrates a perspective view of a cutting element having one or more sensors strategically arranged to determine or indicate wear or damage to the cutting element.

FIG. 2B is a perspective view of a cutting element 105 (e.g., a PDC) having one or more sensors strategically arranged to determine or indicate wear or damage to the cutting element 105. The cutting element 105 may be representative of the cutting elements 158 disposed on the drill bit 150 in FIG. 2A. The cutting element 105 may include a diamond table 100 coupled to a substrate 102. One or more dying sensors 110, 140 may be embedded within various layers of or at various depths in the diamond table 100. Diamond table 100 may have an interface 115 between a layer 120 and a layer 130. Although it may be conceivable that the diamond table 100 could be formed in multiple layers, the layers 120, 130 illustrated do not necessarily limit the formation of diamond table 100 in such a layered construction. Rather the layers 120, 130 and the interface 115 are defined for purposes of identifying the approximate placement of sensor 110, which in the embodiment illustrated in FIG. 2B is positioned at the interface 115. Sensor 110 may be revealed during drilling by the gradual wearing away of the diamond table 100 through layer 120. Layer 120 may have a thickness, t1, of just a few millimeters to tens of centimeters or more, depending on the size of diamond table 100 and the desired wear characteristics to be detected. Similarly, the depth of the interface 115 (and thus the sensor 110) is an amount of approximately t1 from an initial cutting surface 145 of the cutting element 115. When layer 120 is worn away, sensor 110 may be worn away and destroyed.

In some embodiments, diamond table 100 may include additional sensors embedded within the cutting element 115 either at the same or different depths relative to the cutting surface 145. In the embodiment illustrated in FIG. 2B, a second interface 116 exists between the diamond table 100 and the substrate 102. The sensor 140 is positioned at the interface 116 beneath layer 130. Sensor 140 may be revealed during drilling by the gradual wearing away of the diamond table 100 through both layer 120 and layer 130. Again, a thickness or depth, t2, of the diamond table 100 through which wear must occur prior to reaching sensor 140 may be just a few millimeters to tens of centimeters or more, depending on the size of diamond table 100 and the desired wear characteristics to be detected. When layer 120 and layer 130 are worn away, sensor 140 may be worn away and destroyed.

Although in FIG. 2B only interfaces 115, 116 are illustrated, it is contemplated that numerous interfaces at which sensors are placed may be created within a drill bit or cutting element. These interfaces may be carefully placed to accurately detect wear and damage, with sensors at each interface optionally transmitting at a different frequency or period.

The coupling of sensors 110, 140, 155, 156, 157 to drill bit 150 or cutting element 105 may take a variety of forms. The sensors may be coupled by press fitting; bonding by use of adhesives, epoxies, or other bonding agents; welding; brazing; sintering; mechanical coupling such as by the use of screws, pins, rivets, or other fasteners; or any other suitable system or method for coupling. Any of these forms of coupling the sensors may be used to couple the sensors to the surface of the drill bit or cutting element or within recesses, channels, or other cavities formed within the drill bit or cutting element. Alternatively, coupling of the sensor may entail embedding the sensor within the drill bit or cutting element. Embedding the sensor may include incorporating the sensor within the material that is used to form the drill bit or cutting element. For example, cutting elements such as PDCs are formed in a high-pressure, high-temperature press (HPHT) cycle. In a one-step HPHT process, all of the diamond particles, cobalt sintering aid, and other materials are placed loosely in a press and the cutter is formed in a single press. The sensors could be positioned with the materials in the press and integrally formed within the diamond table during formation of the PDC. Alternatively, a two-step HPHT process could be employed to first form the diamond table, and then bond the diamond table to the substrate in a second press with the sensor embedded between the diamond table and the substrate.

Referring still to FIGS. 2A and 2B, the sensors 110, 140, 155, 156, 157 may be of a variety of sensor types, including those that are powered locally, those that harvest energy from an interrogating electromagnetic field, and those that are or include passive or active transmitters. The sensors may be formed to any shape and may be produced to a predetermined size or thickness. While the sensors are not necessarily limited by sizing constraints, in some embodiments, it may be desirable to have nano sensors that have at least one size characteristic (e.g., length, width, height, diameter) that is between about 1 and 100 nanometers. In other embodiments, it may be desirable to have micro sensors that have at least one size characteristic that is between about 1 and 100 micrometers. In the case of sensors that harvest energy or are passive transmitters, a transmitter and receiver may be located downhole in the wellbore such that the transmitter and receiver are only a short distance from the drill bit where the sensor is located. The signal produced by the sensor 110, 140, 155, 156, 157 need not be significantly powerful or complicated, since typically the purpose of such a sensor will be to transmit until destroyed. Sensors 110, 140, 155, 156, 157 may be set to transmit on a variety of intervals depending on how exposed the area is to wear. In some embodiments, similar to those shown in FIGS. 2A and 2B, sensors 110, 140, 155, 156, 157 may be deployed at various depths or locations on a drill bit and may transmit at different radio frequencies or different intervals. Based on differences in the frequencies of transmissions or the intervals of transmissions, a computing system may resolve what area of a drill bit has been destroyed and, therefore, provide an indicator to an operator as to how much wear or damage has occurred, the location of that wear or damage, and what the potential impact is on the wellbore formation system or drill bit. For example, sensor 110 may transmit at a first frequency, and sensor 140 may transmit at a second frequency. When a receiver or computing system ceases to receive transmissions at the first frequency, it may indicate that the drilling speed of the drill bit needs to be reduced, since at least a portion of layer 120 has been worn away. When the receiver or computing system ceases to receive transmissions at the second frequency, it may indicate that the drilling should be stopped, since at least a portion of layer 130 has been worn away and relatively small amount of the diamond table 105 remains.

If multiple sensors of the same frequency or transmission interval are used in or across an area, such as interface 115, then detection of wear may be on the basis of signal strength. For instance, if one hundred sensors are deployed at interface 115, then a receiver or computing system receiving signals on a set frequency may monitor the strength of the signals received and estimate the percentage of layer 110 worn away based on the strength of the signals received. The same holds true for the strength of signals for transmitters transmitting at an interval.

Additionally, the sensors may be designed to measure impacts and compression instead of measuring when a layer or area has worn away. In this embodiment, instead of being designed to be worn away, the sensors are designed to sustain a certain pressure before ceasing to function. Therefore, if the diamond table 100 is compressed beyond a certain pressure threshold, the sensor will cease to function.

Referring now generally to FIGS. 3-7, in other embodiments of the systems and methods disclosed herein, a PDC may include one or more particles coupled to the PDC. The particles in these embodiments are capable of being released from the downhole cutting tool or PDC, and upon release are capable of being detected. Detection of the particles is an indication that the downhole cutting tool or PDC has suffered damage or wear. The particles may be detectable by one or more particle characteristics, including photoluminescence, radioactivity, magnetic properties, the emission of electromagnetic signals such as radio frequency signals, or other suitable particle characteristics. In some configurations, multiple layers of particles may be provided with each layer indicating a particular amount of wear or damage has occurred. The location or extent of damage or wear may be determined depending on the particle characteristics or signatures associated with the particles at each location.

There are multiple ways of detecting released particles. Detection sensors and systems may be deployed downhole, proximate to the drill bit that is in operation. Sensors also may be located remotely, uphole from the drill bit, and in some cases may be positioned at or near the surface of the well. In this embodiment, the mud resulting from drilling operations, which presumably carries any released particles, may be examined by sensors as the mud exits the well.

The coupling of particles to a downhole cutting tool or a PDC is similar to that described for coupling sensors 110, 140, 155, 156, 157 to drill bit 150 or cutting element 105. The particles may be coupled by press fitting; bonding by use of adhesives, epoxies, or other bonding agents; welding; brazing; sintering; mechanical coupling such as by the use of screws, pins, rivets, or other fasteners; or any other suitable system or method for coupling. If the particles are sufficiently small, some of these methods of coupling may not be as suitable as others. The particles may be coupled to the surface of a drill bit or other downhole cutting tool as described previously for the sensors illustrated in FIG. 2A. The particles may be coupled to a PDC or other cutting element, either on a surface of the PDC or within recesses, channels, cavities, or at other interfaces as described in FIGS. 3-7. Coupling of the particles may entail embedding the particles within the downhole cutting tool or cutting element. Embedding the sensor may include incorporating the particles within the material that is used to form the downhole cutting tool or cutting element. For example, in a one-step HPHT process to form a PDC, all of the diamond particles, cobalt sintering aid, and other materials are placed loosely in a press and the cutter is formed in a single press. The particles may be positioned with the materials in the press and integrally formed within the diamond table during formation of the PDC. Alternatively, a two-step HPHT process could be employed to first form the diamond table, and then bond the diamond table to the substrate in a second press with the particles embedded between the diamond table and the substrate.

The particles are not necessarily limited to any particular size or shape. The particles instead may be formed to any shape and may be produced to a predetermined size or thickness. While the particles are not necessarily limited by sizing constraints, in some embodiments, it may be desirable to have nano particles that have at least one size characteristic (e.g., length, width, height, diameter) that is between about 1 and 100 nanometers. In other embodiments, it may be desirable to have micro particles that have at least one size characteristic that is between about 1 and 100 micrometers.

In some embodiments, a first particle may be coupled to the downhole cutting tool or cutting element that has a first particle characteristic that exhibits a first signature. A second particle may be coupled to the downhole cutting tool or cutting element that has a second particle characteristic that exhibits a second signature. The first and second particles are representative of particles that may be coupled to the PDCs described below with reference to FIGS. 3-7. As described previously with reference to FIG. 1, a sensor may be provided that is configured to detect at least one of the first signature of the first particle characteristic and the second signature of the second particle characteristic when the first particle or the second particle is released from the downhole cutting tool or cutting element. The positioning of the sensor may be at or near the surface of the well, or alternatively may be positioned within the wellbore of the well. The release of the first or second particles may occur upon the downhole cutting tool or cutting element wearing by a first amount or a second amount, respectively. The release of the first particle may further indicate wear or damage in a first location of the downhole cutting tool or cutting element at which the first particle is initially positioned. Similarly, the release of the second particle may indicate wear or damage in a second location of the downhole cutting tool or cutting element at which the second particle is initially positioned.

Figure 3:
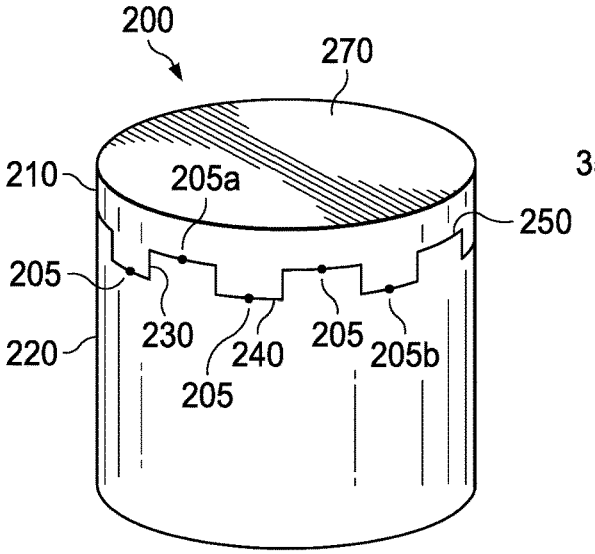
FIG. 3 illustrates a perspective view of an illustrative embodiment of a polycrystalline diamond cutter (PDC) having particles coupled to the PDC.

FIG. 3 is a perspective view of an illustrative embodiment of a PDC 200 having particles 205 coupled to the PDC 200. The PDC 200 includes a diamond table 210 coupled to a substrate 220. Particles 205 may be embedded in the PDC 200 at an interface 230 between the diamond table 210 and the substrate 220. The interface 230 includes valleys 240 and ridges 250, and a first particle 205*a* of the particles 205 may be disposed on one of the ridges 250. A second particle 205*b* of the particles 205 may be disposed in one of the valleys 240. The first particle 205*a* may have a first particle characteristic with a first signature, while the second particle may have a second particle characteristic with a second signature. In some embodiments, the first and second particle characteristics may be different. For example, the first particle 205*a* may exhibit photoluminescence that is detectable upon release, while the second particle 205*b* exhibits radioactivity that is detectable upon release. The detection of a photoluminescent particle in the well may indicate wear of the diamond table 210 by an amount approximately equal to a distance between the ridges 250 and an original cutting surface 270 of the PDC 200. The detection of a radioactive particle in the well may indicate wear of the diamond table 210 by an amount approximately equal to a distance between the valleys 240 and the original cutting surface 270 of the PDC 200. Alternatively, detection of these two particle characteristics may indicate wear or damage in the respective areas associated with the ridges 250 and valleys 240.

In other embodiments, the first and second particle characteristics may be the same, but the first and signatures may be different. For example, the first particle 205*a* may exhibit photoluminescence that has a first signature detectable upon release. The second particle 205*b* may exhibit photoluminescence that has a second signature detectable upon release. The detection of the first signature in the well may indicate wear of the diamond table 210 by an amount approximately equal to the distance between the ridges 250 and an original cutting surface 270 of the PDC 200. The detection of the second signature in the well may indicate wear of the diamond table 210 by an amount approximately equal to a distance between the valleys 240 and the original cutting surface 270 of the PDC 200. Alternatively, detection of these two signatures may indicate wear or damage in the respective areas associated with the ridges 250 and valleys 240.

Figure 4:
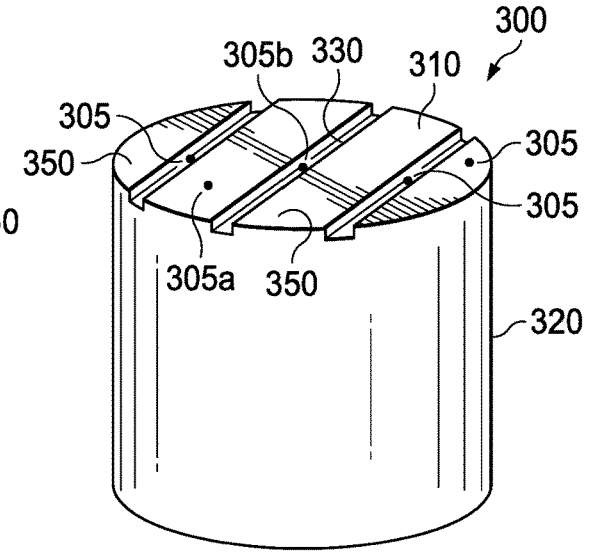
FIG. 4 illustrates a perspective view of an illustrative embodiment of a PDC having particles coupled to the PDC.

FIG. 4 is a perspective view of an illustrative embodiment of a PDC 300 having particles 305 coupled to the PDC 300. The PDC 300 includes a diamond table (not shown in FIG. 4) that is coupled to a substrate 320. A non-planar interface 310 is provided by recesses 330 in the substrate 320. Particles 305 may be disposed at the interface 310 prior to or simultaneous with the diamond table being formed with or coupled to the substrate 320. The interface 310 includes planar regions 350, and a first 305*a* of the particles 305 may be disposed on one of the planar regions 350. A second 305*b* of the particles 305 may be disposed in one of the recesses 330. Similar to the particles 205*a*, 205*b* described in FIG. 3, particles 305*a*, 305*b* may have first and second particle characteristics with first and second signatures, respectively. Detection of the first and second particles 305*a*, 305*b* upon release from the PDC 300, and the ability to distinguish the first particle 305*a* from the second particle 305*b*, may be due to differences in the respective particle characteristics or the respective signatures. Detection of either particle may give an indication of the amount of wear or damage sustained by the PDC 300, or alternatively that wear or damage has occurred in a particular location.

Figure 5:
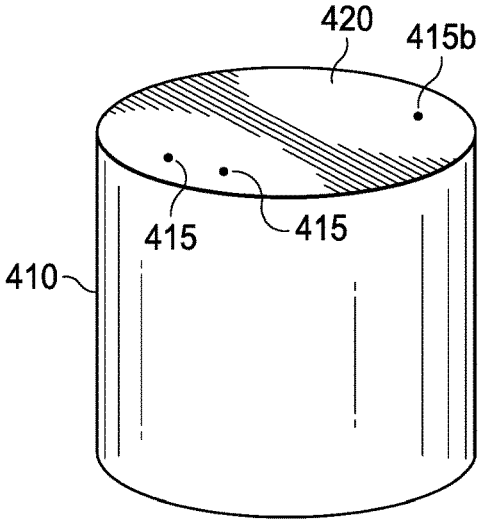
FIG. 5 illustrates a perspective view of an illustrative embodiment of a substrate of a PDC having one or more particles capable upon release of indicating wear or damage to the substrate.
Figure 6:
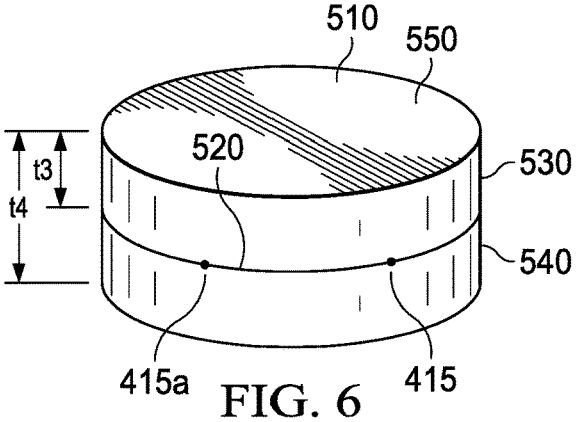
FIG. 6 illustrates a perspective view of an illustrative embodiment of a diamond table of a PDC having one or more particles capable upon release of indicating wear or damage to the diamond table.

FIGS. 5 and 6 are perspective views of illustrative embodiments of a substrate 410 of a PDC and a diamond table 510 of the PDC, each of which may include one or more particles 415 capable upon release of indicating wear or damage to the substrate 410 or the diamond table 510. The substrate 410 and diamond table 510 may be coupled through an HPHT process to form the PDC. An interface 420 (represented by an upper surface of the substrate 410) would be defined between the substrate 410 and the diamond table 510 upon forming the PDC, and prior to or during formation, particles 415 may be included at the interface 420. The interface 420 is substantially planar. The diamond table 510 may have an interface 520 between a layer 530 and a layer 540. Although it may be conceivable that the diamond table 510 could be formed in multiple layers, the layers 530, 540 illustrated do not necessarily limit the formation of diamond table 510 to such a layered construction. Rather the layers 530, 540 and the interface 520 are defined for purposes of identifying the approximate placement of particles 415 in the diamond table.

A first particle 415*a* of the particles 415 may be disposed at the interface 520 of the diamond table 510, and the first particle 415*a* may be revealed during drilling by the gradual wearing away of the diamond table 510 through layer 530. Layer 530 may have a thickness, t3, of just a few millimeters to tens of centimeters or more, depending on the size of diamond table 510 and the desired wear characteristics to be detected. Similarly, the depth of the interface 520 (and thus the first particle 415*a*) is an amount of approximately t3 from an initial cutting surface 550 of the diamond table 510. When layer 530 is worn away, first particle 415*a* may be released from the diamond table 510 such that it may be detected.

A second particle 415*b* of the particles 415 may be disposed at the interface 420 of the substrate 410, and the second particle 415*b* may be revealed during drilling by the gradual wearing away of the diamond table 510 through layers 530 and 540 (assuming the diamond table 510 and substrate 410 are coupled at the interface 420). The thickness or depth, t4, of the diamond table 510 through which wear must occur prior to reaching second particle 415*b* at interface 420 may be just a few millimeters to tens of centimeters or more, depending on the size of diamond table 510 and the desired wear characteristics to be detected. When layer 530 and layer 540 are worn away, second particle 415*b* may be released from the interface 420.

Similar to the particles 205*a*, 205*b* described in FIG. 3, particles 415*a*, 415*b* may have first and second particle characteristics with first and second signatures, respectively. Detecting the first and second particles 415*a*, 415*b* upon release from the diamond table 510 or substrate 410, and distinguishing the first particle 415*a* from the second particle 415*b*, may be accomplished due to differences in the respective particle characteristics or the respective signatures. Detection of either particle may give an indication of the amount of wear or damage sustained by the diamond table 510 or substrate 410, or alternatively that wear or damage has occurred in a particular location.

Figure 7:
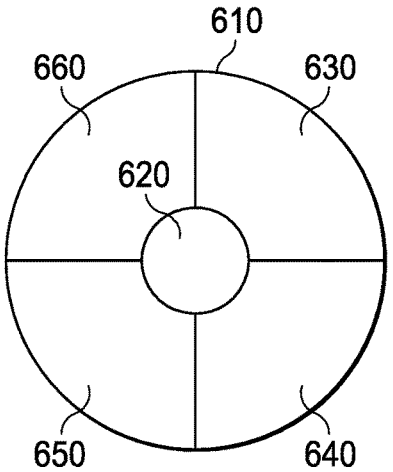
FIG. 7 illustrates a top view of an illustrative embodiment of a diamond table of a PDC or other downhole cutting tool having multiple particle regions to which particles may be coupled.

FIG. 7 is a top view of an embodiment of a diamond table 610 of a PDC or other downhole cutting tool having multiple particle regions 620, 630, 640, 650, 660. Each of the particle regions 620, 630, 640, 650, 660 may include a particle with a different particle characteristic or signature as described above. In operation, when a particle region becomes worn or is damaged, the particle in that region is released, and a sensor is able to identify the particle and the region or location from which it was released.

Figure 8:
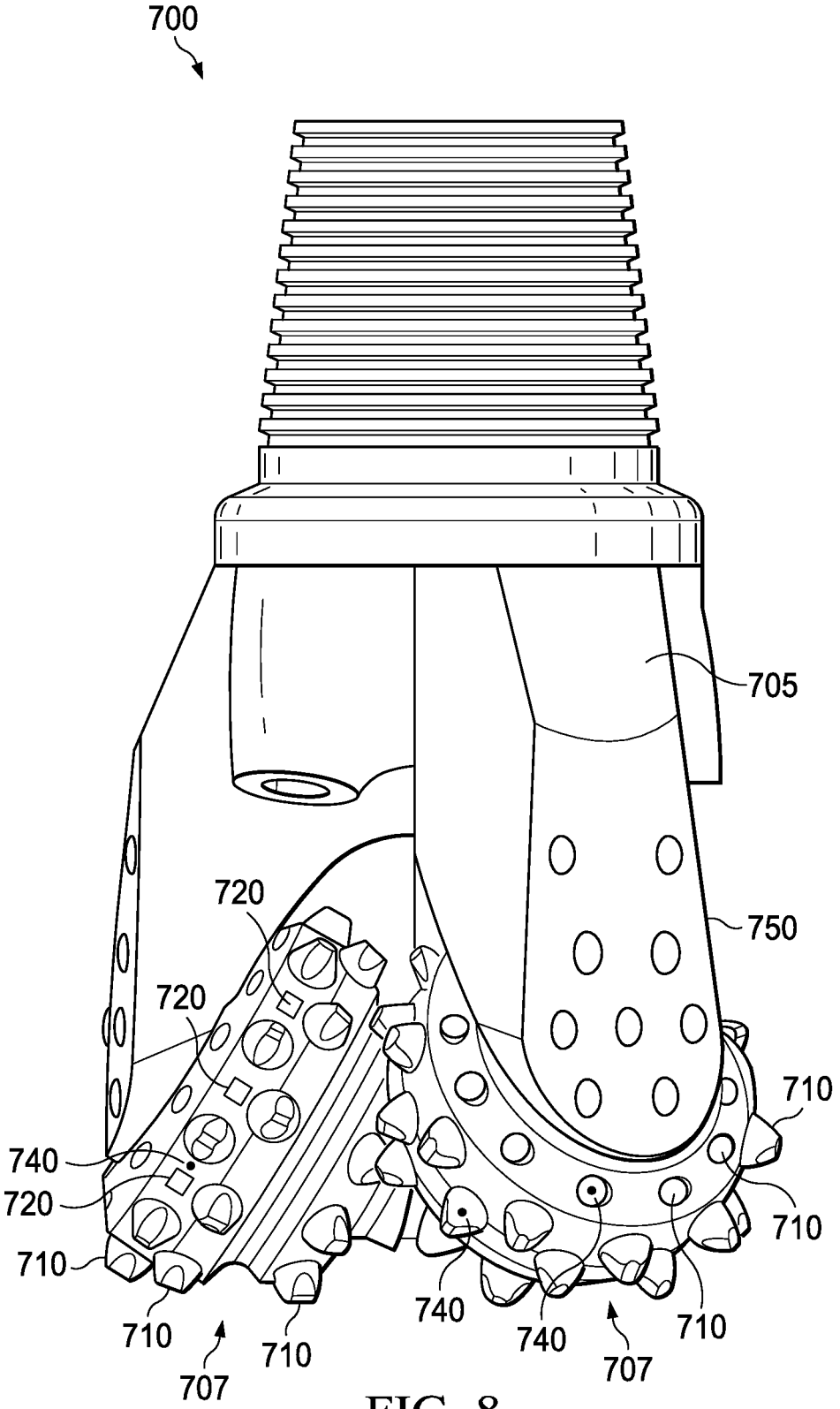
FIG. 8 illustrates a side view of an illustrative embodiment of a drill bit having either or both of sensors and particles for determining that wear or damage has occurred on the drill bit.

FIG. 8 is a side view of an embodiment of a drill bit 700 having either or both of sensors and particles as described herein to determine that wear or damage has occurred on the drill bit 700. The drill bit 700 is a roller cone drill bit having a bit body 705 and a plurality of roller cones 707 rotatably coupled to the bit body 705. Each roller cone 707 is capable of rotating about an axis, and each roller cone 707 includes a plurality of cutting elements 710. The cutting elements 710 may be teeth as illustrated in FIG. 8 or may instead be carbide or other inserts. As described above with respect to drill bit 150 of FIG. 2A, the drill bit 700 may include one or more sensors 720 positioned on a surface of the drill bit 700 or coupled to the cutting elements 710. Sensors 720 may be located between cutting elements 710 so that, as the cutting elements wear away, the sensors 720 will be exposed and worn away, thus ceasing transmission of any signals. Similarly, the sensors 720 may be coupled to (including embedded within) the cutting elements such that wear exposes or destroys the sensor causing the sensor to cease transmission.

One or more particles such as the particles described in FIGS. 3-7 may be coupled to (including embedded within) the drill bit 700 or cutting elements 710. Similar to the PDCs previously described, the teeth or inserts may include embedded particles 740, which upon release are sensed or identified by a sensor to indicate wear or damage to the drill bit 700. The particles 740 may each have different particle characteristics or signatures to allow identification and attribution of a particular particle with a known location or region associated with the drill bit 700.

The drill bits shown and described herein are merely exemplary, and the systems and methods of the disclosure may be implemented in any drill bit, drilling system, or other downhole cutting tool. It should also be noted that the drawings are not to scale, and the particles and sensors shown in the drawings may have size characteristics that on the order of nanometers, micrometers, or other amounts.

The ability to detect wear of or damage to downhole cutting tools while the downhole cutting tools are deployed in a wellbore minimizes the costs associated with drilling and reduces the potential of tool failure in the wellbore. The foregoing disclosure describes tools, systems, and methods that include active or transmitting sensors that are designed to be inactivated, destroyed or worn away upon a particular amount of wear occurring to a downhole cutting tool, or upon wear or damage occurring in a particular location or region of the downhole cutting tool. In another configuration, the tools, systems, and methods include detectable particles that are coupled to the downhole cutting tool and are configured to be released upon a particular amount of wear occurring or when wear or damage occurs in a particular location or region. In addition to the embodiments described above, many examples of specific combinations are within the scope of the disclosure, some of which are detailed below.

EXAMPLE 1

A wellbore formation system comprising:

a downhole cutting tool having a body and at least one cutting element; and a sensor coupled to the downhole cutting tool, the senor having a transmitter configured to transmit a signal prior to wear on a portion of the downhole cutting tool reaching a first amount, the sensor ceasing transmission of the signal when the wear on the portion of the downhole cutting tool reaches the first amount.

EXAMPLE 2

The system of example 1 further comprising:
a receiver configured to receive the signal from the sensor.

EXAMPLE 3

The system of example 2, wherein the receiver is positioned at a surface of a well within which the downhole cutting tool is being used.

EXAMPLE 4

The system of example 2, wherein the receiver is positioned within a well in which the downhole cutting tool is being used.

EXAMPLE 5

The system of any of examples 1-4, wherein the signal transmitted by the transmitter is a radio frequency (RF) signal.

EXAMPLE 6

The system of any of examples 1-5, wherein the sensor is embedded within a surface of the downhole cutting tool.

EXAMPLE 7

The system of any of examples 1-5, wherein the sensor is disposed on a surface of the body between cutting elements.

EXAMPLE 8

The system of any of examples 1-7 further comprising a second sensor coupled to the downhole cutting tool, the second sensor having a second transmitter configured to transmit a second signal prior to wear on a second portion of the downhole cutting tool reaching a second amount, the second sensor ceasing transmission of the second signal when the wear on the second portion of the downhole cutting tool reaches the second amount.

EXAMPLE 9

The system of example 8, wherein the first signal is at a first frequency and the second signal is at a second frequency.

EXAMPLE 10

The system of any of examples 1-9, wherein at the first amount, the sensor is exposed to a downhole fluid, thereby causing the sensor to cease transmitting the signal.

EXAMPLE 11

The system of any of examples 1-10, wherein at the first amount, the sensor ceases transmitting the signal due to impact of the sensor with another object.

EXAMPLE 12

A wellbore formation system comprising:
a downhole cutting tool having a body and at least one cutting element;
a first particle disposed on the downhole cutting tool, the particle having a first particle characteristic that exhibits a first signature;
a second particle disposed on the downhole cutting tool, the second particle having a second particle characteristic that exhibits a second signature; and
a sensor configured to detect at least one of the first signature of the first particle characteristic and the second signature of the second particle characteristic when the first particle or the second particle is released from the downhole cutting tool.

EXAMPLE 13

The system of example 12, wherein the first particle is released from the downhole cutting tool when a portion of the downhole tool wears by a first amount.

EXAMPLE 14

The system of example 13, wherein the second particle is released from the downhole cutting tool when a portion of the downhole tool wears by a second amount.

EXAMPLE 15

The system of any of examples 12-14, wherein the first particle is released from a first location of the downhole cutting tool indicating wear in the first location.

EXAMPLE 16

The system of example 15, wherein the second particle is released from a second location of the downhole cutting tool indicating wear in the second location.

EXAMPLE 17

The system of any of examples 12-16, wherein the first and second particles are nanoparticles.

EXAMPLE 18

The system of any of examples 12-16, wherein the first and second particles are microparticles.

EXAMPLE 19

The system of any of examples 12-18, wherein:
the downhole cutting tool is a fixed cutter drill bit;
the at least one cutting element is a polycrystalline diamond cutter (PDC) having a diamond table coupled to a substrate; and
the first particle is embedded within the diamond table.

EXAMPLE 20

The system of example 19, wherein:
the first particle is located within the diamond table a first distance from a cutting surface of the PDC cutter; and
the first particle is released from the PDC cutter when the PDC cutter wears by the first distance.

EXAMPLE 21

The system of any of examples 12-18, wherein:
the downhole cutting tool is a fixed cutter drill bit;
the at least one cutting element is a polycrystalline diamond cutter (PDC) having a diamond table coupled to a substrate; and the first particle is embedded at an interface between the diamond table and the substrate.

EXAMPLE 22

The system of example 21, wherein:

the first particle is located within the diamond table a first distance from a cutting surface of the PDC cutter; and the first particle is released from the PDC cutter when wear on the PDC cutter reaches the interface.

EXAMPLE 23

The system of any of examples 12-18, wherein at least one of the first particle and the second particle is coupled to a surface of the body.

EXAMPLE 24

The system of any of examples 12-18, wherein:

the first particle is embedded within the downhole cutting tool at a first depth; and the second particle is embedded within the downhole cutting tool at a second depth.

EXAMPLE 25

The system of any of examples 12-24, wherein the sensor is configured to detect the first signature of the first particle characteristic and the system further comprises:

a second sensor configured to detect the second signature of the second particle characteristic.

EXAMPLE 26

The system of any of examples 12-25, wherein the second particle characteristic is the same as the first particle characteristic.

EXAMPLE 27

The system of example 26, wherein the second signature is different than the first signature.

EXAMPLE 28

The system of any of examples 12-27, wherein:

the first particle characteristic is selected from the group of a photoluminescence property, a radioactivity property, a magnetic property, and a radio frequency property; and the second particle characteristic is selected from the group of the photoluminescence property, the radioactivity property, the magnetic property, and the radio frequency property.

EXAMPLE 29

A method for detecting wear on a downhole cutting tool, the method comprising:

operating the downhole cutting tool to remove material in a wellbore;

detecting a first signature of a first particle characteristic indicating a first amount of wear at a first portion of the downhole cutting tool; and detecting a second signature of a second particle characteristic indicating a second amount of wear at a second portion of the downhole cutting tool.

EXAMPLE 30

The method of example 29, wherein the first particle characteristic is the same as the second particle characteristic.

EXAMPLE 31

The method of examples 29 or 30, wherein:

the first particle characteristic is selected from the group of a photoluminescent property, a radioactivity property, a magnetic property, and a radio frequency property; and the second particle characteristic is selected from the group of the photoluminescent property, the radioactivity property, the magnetic property, and the radio frequency property.

EXAMPLE 32

The method of any of examples 29-31, wherein:

detection of the first signature is indicative of the downhole cutting tool wearing to a first depth; and detection of the second signature is indicative of the downhole cutting tool wearing to a second depth.

EXAMPLE 33

The method of any of examples 29-32, wherein:

detection of the first signature is indicative of the downhole cutting tool wearing in a first location; and detection of the second signature is indicative of the downhole cutting tool wearing in a second location.

It should be apparent from the foregoing that the various features embodied in the disclosed example embodiments are not limited to only those example embodiments. Various changes and modifications are possible without departing from the spirit thereof.

What is claimed is:

1. A wellbore formation system comprising:

a downhole cutting tool having a drill bit that includes a body and at least one cutting element attached to the body;

a first particle disposed at a first interface between a first layer and a second layer on the at least one cutting element, the first particle having a characteristic that exhibits photoluminescence as a first signature;

a second particle disposed at a second interface between the second layer and a third layer on the at least one cutting element, the second particle having a second particle characteristic that exhibits photoluminescence as a second signature, wherein the second particle is a second nanoparticle or a second microparticle; and a sensor configured to detect at least one of the first signature of the first particle characteristic and the second signature of the second particle characteristic when the first particle or the second particle is released from the downhole cutting tool and wherein the sensor is disposed on the drill bit.

2. The system of claim 1, wherein the first particle is released from the downhole cutting tool when a portion of the downhole tool wears by a first amount.

3. The system of claim 2, wherein the second particle is released from the downhole cutting tool when a portion of the downhole tool wears by a second amount.

4. The system of claim 1, wherein the first particle is released from a first location of the downhole cutting tool indicating wear in the first location.

5. The system of claim 4, wherein the second particle is released from a second location of the downhole cutting tool indicating wear in the second location.

6. The system of claim 1, wherein:

the downhole cutting tool is a fixed cutter drill bit;

the at least one cutting element is a polycrystalline diamond cutter (PDC) having a diamond table coupled to a substrate; and the first particle is embedded within the diamond table.

7. The system of claim 6, wherein:

the first particle is located within the diamond table a first distance from a cutting surface of the PDC cutter; and the first particle is released from the PDC cutter when the PDC cutter wears by the first distance.

8. The system of claim 1, wherein:

the downhole cutting tool is a fixed cutter drill bit;

the at least one cutting element is a polycrystalline diamond cutter (PDC) having a diamond table coupled to a substrate; and the first particle is embedded at an interface between the diamond table and the substrate.

9. The system of claim 8, wherein:

the first particle is located within the diamond table a first distance from a cutting surface of the PDC cutter; and the first particle is released from the PDC cutter when wear on the PDC cutter reaches the interface.

10. The system of claim 1, wherein at least one of the first particle and the second particle is coupled to a surface of the body.

11. The system of claim 1, wherein:

the first particle is embedded within the downhole cutting tool at a first depth; and the second particle is embedded within the downhole cutting tool at a second depth.

12. The system of claim 1, wherein the sensor is configured to detect the first signature of the first particle characteristic and the system further comprises:

a second sensor configured to detect the second signature of the second particle characteristic.

13. The system of claim 1, wherein the second particle characteristic is the same as the first particle characteristic.

14. The system of claim 13, wherein the second signature is different than the first signature.

15. The system of claim 1, wherein:

the first particle characteristic further includes a magnetic property or a radio frequency property; and the second particle characteristic further includes the magnetic property or the radio frequency property.

16. A method for detecting wear on a downhole cutting tool, the method comprising:

operating the downhole cutting tool to remove material in a wellbore wherein the downhole cutting tool includes a drill bit that includes a body and at least one cutting element attached to the body, wherein a first particle having a characteristic of photoluminescence is disposed at a first interface between a first layer and a second layer on the at least one cutting element, and a second particle having a characteristic of photoluminescence is disposed at a second interface between the second layer and a third layer on the at least one cutting element;

detecting a first particle characteristic within the wellbore by a sensor disposed on the drill bit indicating a first amount of wear at a first portion of the at least one cutting element, wherein the first particle is a first nanoparticle or a first microparticle; and detecting a second particle characteristic within the wellbore by the sensor indicating a second amount of wear at a second portion of the at least one cutting element, wherein the first particle is a second nanoparticle or a second microparticle.

17. The method of claim 16, wherein the first particle characteristic is the same as the second particle characteristic.

18. The method of claim 16, wherein:

the first particle characteristic is a radioactivity property, a magnetic property, or a radio frequency property; and the second particle characteristic is the radioactivity property, the magnetic property, or the radio frequency property.

19. The method of claim 16, wherein:

detection of the first signature is indicative of the downhole cutting tool wearing to a first depth; and detection of the second signature is indicative of the downhole cutting tool wearing to a second depth.

20. The method of claim 16, wherein:

detection of the first signature is indicative of the downhole cutting tool wearing in a first location; and detection of the second signature is indicative of the downhole cutting tool wearing in a second location.

* * * * *